United States Patent [19]

Galyardt

[11] Patent Number: 4,817,759

[45] Date of Patent: Apr. 4, 1989

[54] ACCESS PLATFORM FOR SLIDING GLASS WINDOWS

[76] Inventor: Marv Galyardt, 36711 Port Fogwood Pl., Newark, Calif. 94560

[21] Appl. No.: 184,003

[22] Filed: Apr. 20, 1988

[51] Int. Cl.[4] ..... E04G 3/06

[52] U.S. Cl. ..... 182/36; 182/61

[58] Field of Search ..... 182/53–62, 182/36

[56] References Cited

U.S. PATENT DOCUMENTS

| | | | |
|---|---|---|---|
| 266,691 | 10/1882 | Heimsath | 182/60 |
| 303,980 | 8/1884 | Bruener | 182/57 |
| 353,634 | 11/1886 | Husemann | 182/57 |
| 1,392,820 | 10/1921 | Davis | 182/36 |
| 1,456,362 | 5/1923 | Cresson | 182/61 |
| 1,830,830 | 11/1931 | Federico | 182/54 |
| 2,167,982 | 8/1939 | Kerber | 182/54 |
| 4,320,816 | 3/1982 | Callahan | 182/60 |

*Primary Examiner*—Reinaldo P. Machado
*Attorney, Agent, or Firm*—Bielen & Peterson

[57] ABSTRACT

A portable access platform for access to the outside of conventional sliding glass windows the access platform having a clamping unit that clamps to the window sill of the open portion of the window unit when one of the windows is slid aside, an elongated slide unit that is slidably connected to the clamping unit and that is arranged outside the window unit below the sill, a platform unit that is slidably connected to the slide unit and positioned at the closed portion of the window unit, the clamping unit and platform unit being moveable to opposite ends of the slide unit for access to the other side of the window unit when the windows are oppositely positioned.

10 Claims, 2 Drawing Sheets

10
12
14
16
18
20
22
24
26
28
30
32
36
38
40
42
44
46
48
50
52
54
56
58
62
64
66
69
70
72
74
76
78
80
90
92
94
96
98
100
102
104
106

ACCESS PLATFORM FOR SLIDING GLASS WINDOWS

BACKGROUND OF THE INVENTION

This invention relates to an access platform for sliding glass windows which are used extensively in apartments and condominiums. While access to such windows during building construction is customarily provided by scaffolding, once the building completed there is often no efficient means for accessing the outside of such standard type of window for inspection or repair. While the use of a ladder is effective for a first and second story, access to the windows at higher elevations must be provided by some other means. Customarily, suspended platforms are used. However, these devices are heavy and difficult to install and are particularly unsuitable for repair of a small number of windows.

The access platform of this invention is portable and light in weight such that a single man can install and use the platform without spending any significant time in preparing the platform for use. The extensive use of horizontally sliding glass windows mounted in aluminum cases requires some inexpensive means to access both the window and casing from inside the building. While sliding glass windows can be cleaned with some difficulty from the window sill, and, if necessary, the window can be removed from the casing or frame for cleaning or repair, access to the installed casing presents a more dangerous situation. When, for example, it is required that the casing be resealed by laying a caulking bead around the perimeter of the casing, the worker is exposed to a difficult situation, particularly where the control of the caulking gun is important at difficult to reach positions.

The access platform of this invention is a portable device that can be quickly installed by a single worker and can be effectively used when repairing or inspecting even a single window casing. Unlike prior devices that must be suspended from the building roof which generally require several workers to install and operate, the subject platform is mounted from the window sill and allows the worker to step outside the window for complete access to both the window and the window casing. Because of the unique operation of the modern sliding glass window, the access platform is designed to safely allow access to each side of the window casing in turn.

These and other features of the sliding window access platform will become apparent on the consideration of the preferred embodiments enclosed.

SUMMARY OF THE INVENTION

The access platform of this invention is designed for use with sliding glass windows of the type extensively used in apartments, condominiums and other building of moderate height. These sliding glass windows provide both an expansive area and allows the window to be opened horizontally by one of generally two window sections slidably engaged in a track formed in the window casing. The windows of this type are of generally standard sizes and are of similar construction. The window casing are designed to accommodate the sliding glass windows within fairly close tolerances and are seeded in the window opening during construction as unitary frame. Frequently, however, the seal between the casing and the building parts from weathering, allowing undesirable water intrusion. Periodically, the window casing should be inspected and the seam between frame and building be resealed. While this can be accomplished from inside the building by positioning the worker on the sill, the limited support surface makes both inspection and repair difficult and dangerous.

The access platform of this invention, is a light weight unit that is preferably fabricated from aluminum and can be carried and installed by difficulty without a single worker. The access platform includes a support frame having a clamping mechanism that clamps to the sill of the open side of the window and suspends an outside slide unit or support track below the sill across both the open and closed side of the window. Slidably engaging the support track is a platform having underbraces that contact the outside of the building for structurally supporting the full weight of a worker on the platform. The support platform can be slid to the proper position for the desired access to the window frame. To prevent an inadvertent sliding of the platform once the platform is positioned, its location can be fixed by use of pins inserted in the tracks of the slide unit to block travel of the platform. In addition, to prevent any possibility of a tilt of the platform, the end of the support track proximate the clamping mechanism includes a brace which extends to the top of the window casing where it is secured by a small clamp. The platform clamping mechanism is also slidably engaged with the support track such that the access platform can be adjusted with the clamping mechanism and platform moved to opposite ends of the support track for access to the other side of the window casing. For such repositioning the elongated brace is removed from one end of the slide support unit and is attached at the opposite end.

Other new and useful features of this invention will become apparent upon a consideration of the detailed description of the preferred embodiment described hereafter.

DETAILED DESCRIPTION OF THE PREFERRED EMBODIMENTS

Figure 1:
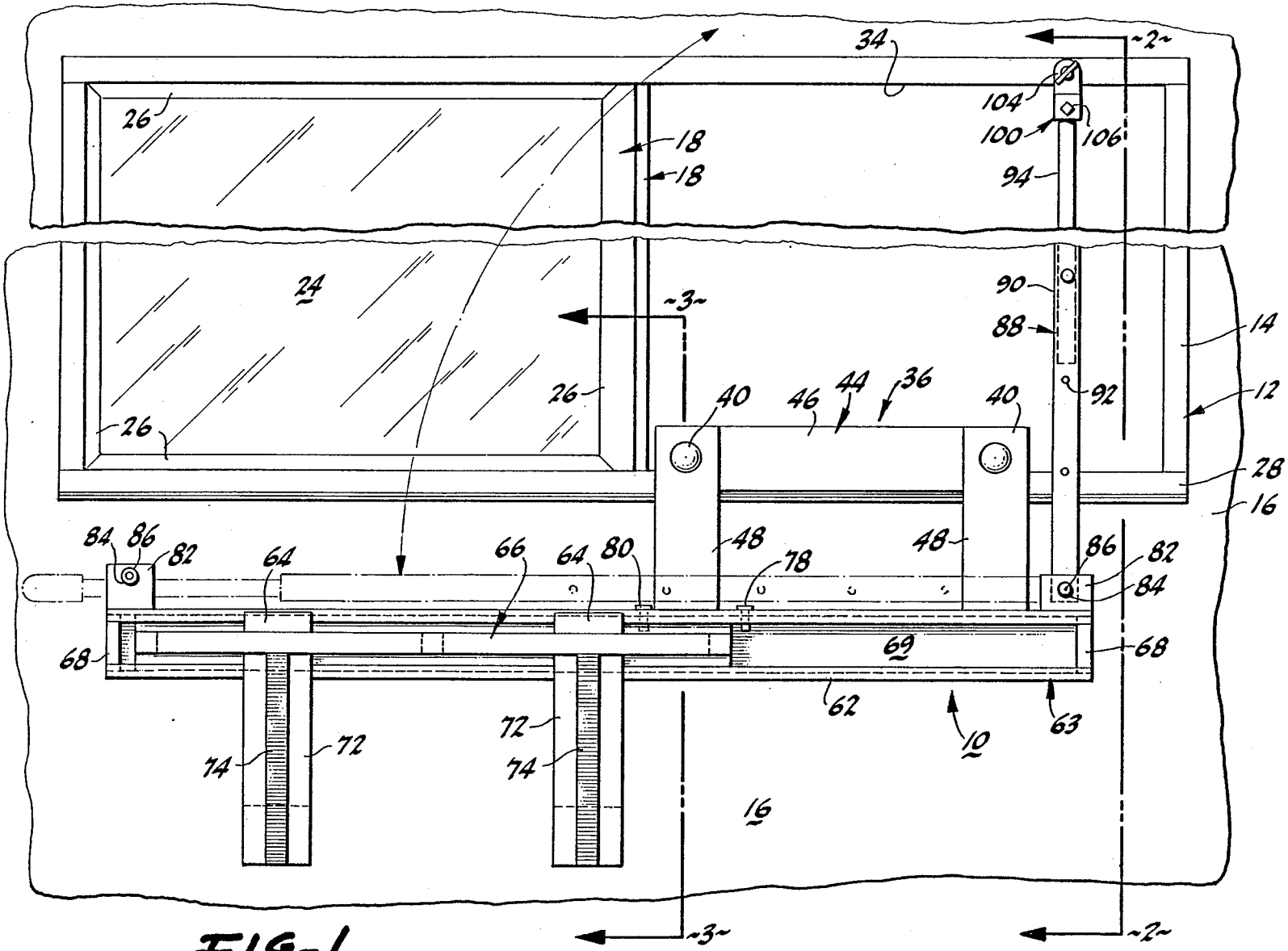
FIG. 1 is a front elevational view of the access platform installed on a typical sliding glass window.

Referring now to FIG. 1, the portable access platform, designated generally by the reference number 10 is shown mounted to a conventional sliding glass window unit 12.

The window unit 12 is of conventional construction with an aluminum casing 14 structurally mounted in a building wall 16 with two sliding glass windows 18 moved to an overlaying position as shown in FIG. 1 with approximately half of the casing 14 being open. The aluminum casing 14 is an extrusion of conventional cross section that encases the windows 18 as shown in part in FIG. 2.

In the simple arrangement shown, the windows 18 are constructed with glass panes 24 that are mounted in aluminum frames 26 with the frames 26 retained and guided in channels 20 and 22 of the aluminum casing 14. The bottom member 28 of the casing 14 includes a flashing lip 30 and drip sill 32. The configuration of the bottom member 28 of the casing 18 is shown in the cross section of FIG. 2, which also details the conventional construction of the building wall 16.

The access platform 10 is mounted in this conventional window unit 12 through the open section 34 when one of the windows is slid adjacent to the other in its open position as shown in FIG. 1. Access platform 10 has a clamping unit 36 which engages the window sill 38. The clamping unit 36 includes a pair of spaced carriage bolts 40 that interconnect an inside clamping member 42 and an outside clamping member 44. The clamping members 42 and 44 each include top horizontal plates 46 connected to spaced, depending vertical plates 48 the inside of which are joined to an interconnecting cross plate 50 and the outside of which are connected to a slide plate 52. The carriage bolts 40 go through the junction of the vertical plates 48 and the top horizontal plates 46. The carriage bolts 40 have a protective rubber sleeve 54 which seats on the bottom member 28 of the window casing 14. Similarly, the inside cross plate 50 and the slide plate 52 have lower pads 56 and upper pads 58 to protect the inside and outside surfaces of the building wall 16. By tightening the wing nuts 60 the inside clamping member and outside clamping member can be displaced with respect to one another to securely clamp the access platform 10 to the window sill 38 or release the members on removal.

Figures 2, 3:
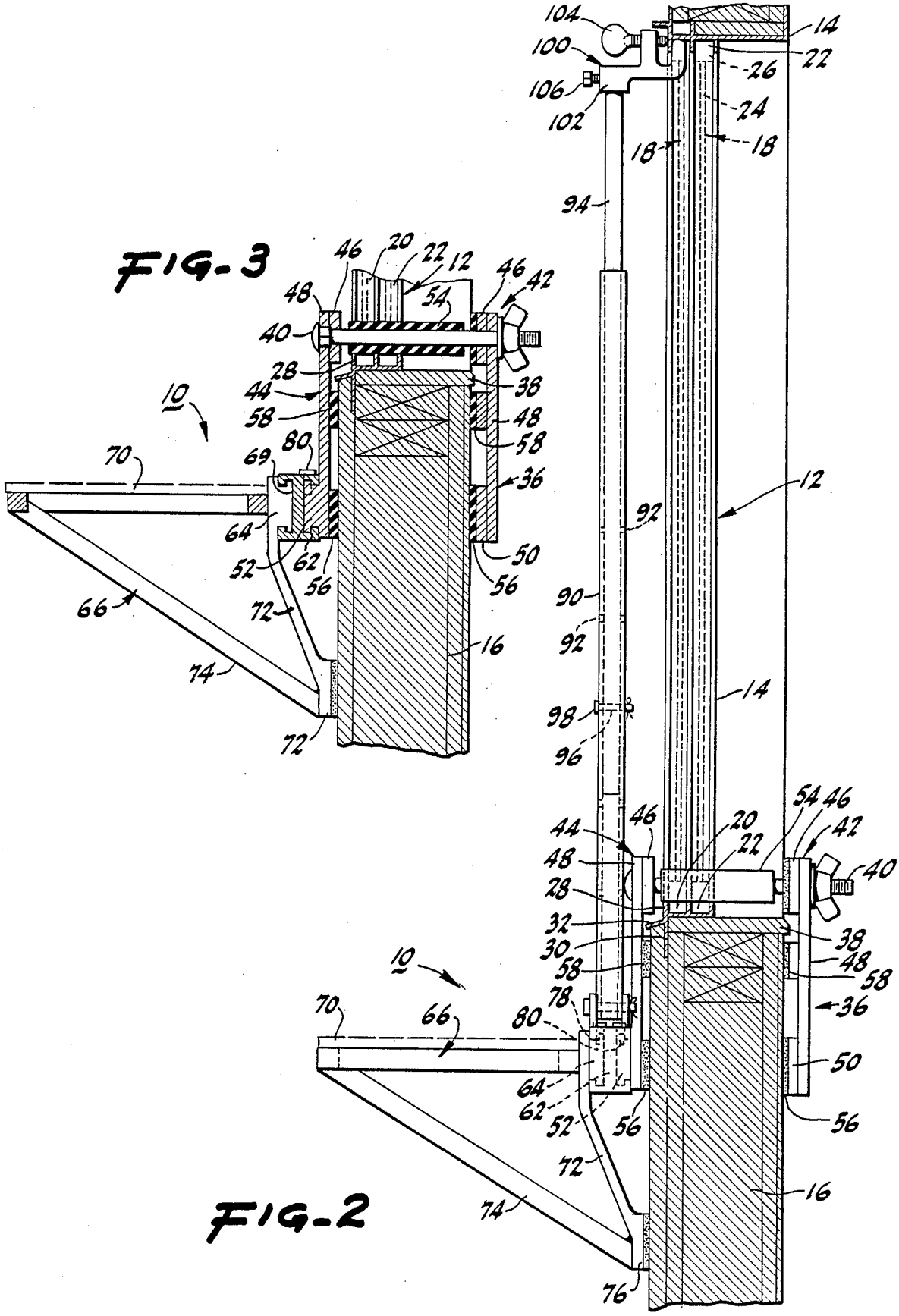
FIG. 2 is a side elevational view partially in cross section taken on the lines 2—2 in FIG. 1.
FIG. 3 is a partial cross sectional view taken on the lines 3—3 in FIG. 1.

The slide plate 52 slidably engages an elongated guide track 62 of a slide unit 63. The slide unit 63 has a symmetrical cross section as shown in FIG. 3 that permits slidable engagement of an outer slide plate 64 on a platform unit 66 in a manner similar to the clamping unit. The elongated track 62 of the slide unit 63 has end stops 68 on each end of T-shaped channels 69 in the track to limit displacement. The platform unit could be fixed to the slide unit if it extended the entire width of the window unit, but it would have certain disadvantages in conducting repairs, particularly under the sill.

The platform unit 66 includes a top deck 70 with two depending supports 72 and struts 74 that connect at a seating pads 76 which contact the outer building wall 16 for structural support of the top deck 70. The platform unit 66 can displace along the track 62 for positioning the platform at one end of the slide unit 63 or below the other. In this manner, by switching ends of the access platform 10 can be adapted to the window unit 12 when the open section 34 is at either side of the window. To insure that the platform unit 66 does not inadvertently displace while in use, a stop pin 78 is installed in the top of the track 62, and a similar pin 80 is installed in the track 62 to limit displacements. These pins 78 and 80 depend into the T-shaped the channels 69 thereby preventing displacement of both the platform unit and the clamping unit.

At each end of the elongated channel 62 is a yoke bracket 82 with a hole 84 for a cross pin 86. The cross pin 86 engages one end of an elongated telescoping brace unit 88 having an outer tube 90 with position holes 92 and an inner tube 94 having a hole 96 for a cross pin 98. On proper alignment of the holes in the outer tubes with a selected hole in the inner tube, the brace unit 88 can be extended to any of a series of positions that enable the brace unit to be used with a variety of standard sized windows. The brace unit 88 has a clamping member 100 at its distal end. The clamping member 100 comprises a bracket element 102 and a thumb screw 104 connected to the bracket element for clamping the bracket element with the thumb screw to the aluminum casing 14 of the window unit 12. The clamping member 100 may be fixed to the end of the inner tube 94 by a set screw 106. By removal of the cross pin 86 it can be seen that the brace unit 88 can be moved to the opposite end of the elongated channel 62 and mounted to the yoke bracket 82 at such end. The tubular brace unit 88 is placed into position in the upper corner of the window casing 14 such that the weights of a worker on the platform unit 66 does not pivot the access platform 10 about the center most carriage bolt 40.

The access platform 10 is easily and quickly installed through the open portion of a window unit 12 allowing the worker to step out on to the top surface of the platform unit to access the far half of the window casing. When inspection and repair of one side of the aluminum casing has been completed, the access platform can be taken in and the window slid to the opposite side of the casing and the access platform reinstalled through the open portion for access for the opposite slide of the case. When using the platform a safety rope should naturally be used. If there is no secure place inside the building to secure the end of the line to, it can be secured to the center most carriage bolt.

While in the foregoing embodiments of the present invention have been set forth in considerable detail for the purposes of making a complete disclosure of the invention, it may be apparent to those of skill in the art that numerous chambers may be made in such detail without departing from the spirit and principles of the invention.

What is claimed is:

1. A portable access platform for access to the outside of a conventional sliding window unit having a casing with a sill and a pair of sliding windows, which create an open portion and a closed portion in the window unit when one of the windows is slid aside the other, the access platform comprising:

a clamping unit having means for clamping the clamping unit securely over a section of the casing sill in the open portion of the window unit;

an elongated slide unit slidably engaged with the clamping unit and constructed and arranged to extend below the outside sill of the window unit with ends reaching approximately the length of the sill when the clamping unit is installed and the access platform is in place;

a platform unit connected to the slide unit and arrangeable at least along the closed portion of the window unit when the access platform is in place;

wherein the clamping unit is slidable along the slide unit for moving the clamping unit from one end of the slide unit to the other for select installation of the access platform for access to either side of the window unit upon sliding a window to one side or the other.

2. The access platform of claim 1 wherein the platform unit has a width approximately half the length of the slide unit and is slidabley connected to the slide unit for displacement from one end of the slide unit to the other.

3. The access platform of claim 2 wherein the clamping means of the clamping unit has first and second clamping members arrangeable respectively, on the inside and outside of the sill of the open portion of the window unit, the clamping members being interconnected by screw means for clamping or releasing the clamping members, the window unit being installed in a wall structure, and the clamping members having pad elements contacting the inside and outside of the wall structure below the sill of the window unit.

4. The access platform of claim 2 having further an elongated brace element connectable to the slide unit at the end proximate the position of the clamping unit when installed, the brace element having a distal end with means to engage the casing proximate the top of the window unit to prevent dislocation of the access platform when in use.

5. The access platform of claim 4 wherein the means to engage the casing comprises a bracket with a screw clamp.

6. The access platform of claim 4 wherein the elongated brace element is telescopically constructed with an outer tube, inner tube and adjustment means for adjusting the length of the window unit in which the access platform is installed.

7. The access platform of claim 4 wherein the brace element is connectable to either end of the slide unit depending on the position of the clamping unit.

8. The access platform of claim 2 wherein the slide unit comprises an elongated extrusion with inside and outside guide tracks for slidable engagement of the clamping unit and platform unit, respectively.

9. The access platform of claim 3 wherein the platform unit has a top platform deck with a brace structure under the platform deck, the brace structure having contact pads which contact the outside wall structure when the access platform is installed.

10. The access platform of claim 2 having further safety stop means for preventing displacement of the platform unit and the clamping unit when the access platform is installed.

* * * * *